US010697191B1

(12) United States Patent
Ramos

(10) Patent No.: US 10,697,191 B1
(45) Date of Patent: Jun. 30, 2020

(54) SKIMMER NET APPARATUS

(71) Applicant: Arturo Ramos, Union City, CA (US)

(72) Inventor: Arturo Ramos, Union City, CA (US)

( * ) Notice: Subject to any disclaimer, the term of this patent is extended or adjusted under 35 U.S.C. 154(b) by 0 days.

(21) Appl. No.: 16/372,142

(22) Filed: Apr. 1, 2019

(51) Int. Cl.
*E04H 4/16* (2006.01)

(52) U.S. Cl.
CPC ..... *E04H 4/1609* (2013.01)

(58) Field of Classification Search
CPC ..... E04H 4/1609
USPC ..... 210/167.1, 238, 470, 471
See application file for complete search history.

(56) References Cited

U.S. PATENT DOCUMENTS 5,385,666 A * 1/1995 Perlsweig ..... E04H 4/1609 15/1.7
6,383,374 B1 * 5/2002 Splendorio ..... E04H 4/1254 210/238
6,412,213 B1 * 7/2002 Wellard ..... A01K 77/00 43/12

* cited by examiner

*Primary Examiner* — Fred Prince
(74) *Attorney, Agent, or Firm* — Lamon Patent Services; Cynthia S. Lamon

(57) ABSTRACT

A skimmer apparatus has a handle, a net-bottom-rod at a right angle to the handle, offset from the axis of the handle and joined rigidly to an extension of the handle, a movable frame rotatable about an axis at a right angle to the axis of the handle, a slider translatable on the handle, a linkage mechanism joined to the movable frame and to the slider rotating the movable frame about the axis at a right angle to the axis of the handle, and net material joined to the movable frame and to the net-bottom-rod. Moving the slider away from the net employs the linkage mechanism to rotate the movable frame past the net-bottom-rod, such that the net is turned inside out, facilitating divesting material captured in the net.

10 Claims, 3 Drawing Sheets

SKIMMER NET APPARATUS

BACKGROUND OF THE INVENTION

1. Field of the Invention

The present invention is in the technical area of apparatus for cleaning and servicing pools and spas, and relates more particularly to a skimmer net that may be easily emptied without direct hand contact.

2. Description of Related Art

Nets for skimming debris and other unwanted matter from pools and spas are well-known in the art. It is quite common to get a nasty green pool full of algae when the pool owner neglects to service the pool for a few weeks or months. In this circumstance hand contact with a net used to clean may be dangerous, as well as just unsanitary. In such a circumstance it is common to encounter dead animals like mice, squirrels, lizards, worms and so on. Also rotten vegetable matter, like leaves and grass. Such offal may be infested with dangerous bacteria, as well.

Nets in the conventional art require that a user empty the net by hand manipulation. What is needed is a skimmer net that enables reversal and emptying the net without ever being directly touched.

BRIEF SUMMARY OF THE INVENTION

In one embodiment of the invention a skimmer net apparatus is provided, comprising a handle having a first and a second end and a length having an axis, a net-bottom-rod having a length with an axis at a right angle to the axis of the handle, offset from the axis of the handle by a depth dimension, a rigid coupling joining the net-bottom-rod to an extension of the handle, a movable frame having a shape defining a top of a net, with a width and a length, the movable frame rotatable about an axis at a right angle to the axis of the handle, a slider implemented on the handle, translatable in a direction of the axis of the handle, a linkage mechanism joined to the movable frame and to the slider, such that translating the slider along the handle rotates the movable frame about the axis at a right angle to the axis of the handle, and net material joined to the movable frame along the shape defining the top of a net and to the net-bottom-rod. With the movable frame in a horizontal position forward of the handle, a net is implemented between the shape of the movable frame and the net-bottom-rod, enabling capture of material in the net by manipulation of the handle, and wherein moving the slider in a direction away from the net employs the linkage mechanism to rotate the movable frame about the axis at a right angle to the axis of the handle, past the net-bottom-rod, such that the net is turned inside out, facilitating divesting material captured in the net.

In one embodiment the apparatus further comprises a fixed frame in the shape of the movable frame, the fixed frame rigidly joined to the extension of the handle, such that the movable frame in a horizontal position surrounds and locates onto the fixed frame, providing the fixed and movable frames in a common position. Also, in one embodiment the a rigid coupling joining the net-bottom-rod, joins rigidly to a front edge of the fixed frame. In one embodiment the apparatus further comprises a locking mechanism usable to lock the slider to the handle in a variety of different positions. And in one embodiment one of the variety of different position in which the slider may be locked to the handle is the position where the movable frame is in a horizontal position forward of the handle.

In another aspect of the invention a method for emptying a skimmer net without hand contact is provided, comprising positioning a net-bottom-rod at a right angle to and offset from an axis of a handle having a first and a second end and a length, with the net-bottom-rod rigidly attached to an extension of the handle, pivoting a movable frame having a shape defining a top of a net, with a width and a length, about an axis at a right angle to the extension of the handle, imposing net material joined around a periphery of the movable frame and the net-bottom-rod, providing a net with an open top defined by the movable frame and a fixed bottom defined by the net-bottom-rod, imposing a linkage mechanism between a slider on the handle and an offset from the movable frame, such that retracting the slider on the handle rotates the movable frame downward around the axis at a right angle to the extension of the handle, and moving the slider along the handle away from the extension of the handle, causing the movable frame to rotate about the axis at a right angle to the extension of the handle, past the fixed net bottom held by the net-bottom-rod, inverting the net to be inside out, and emptying any material collected in the net.

In one embodiment of the method further comprising implementing a fixed frame in the shape of the movable frame, the fixed frame rigidly joined to the extension of the handle, such that the movable frame in a horizontal position surrounds and locates onto the fixed frame, providing the fixed and movable frames in a common position. In one embodiment the method further comprises joining the net-bottom-rod rigidly to a front edge of the fixed frame. In one embodiment the method further comprises imposing a locking mechanism on the slider, the locking mechanism usable to lock the slider to the handle in a variety of different positions. And in one embodiment one of the variety of different position in which the slider may be locked to the handle is the position where the movable frame is in a horizontal position forward of the handle.

DETAILED DESCRIPTION OF THE INVENTION

Figure 1:
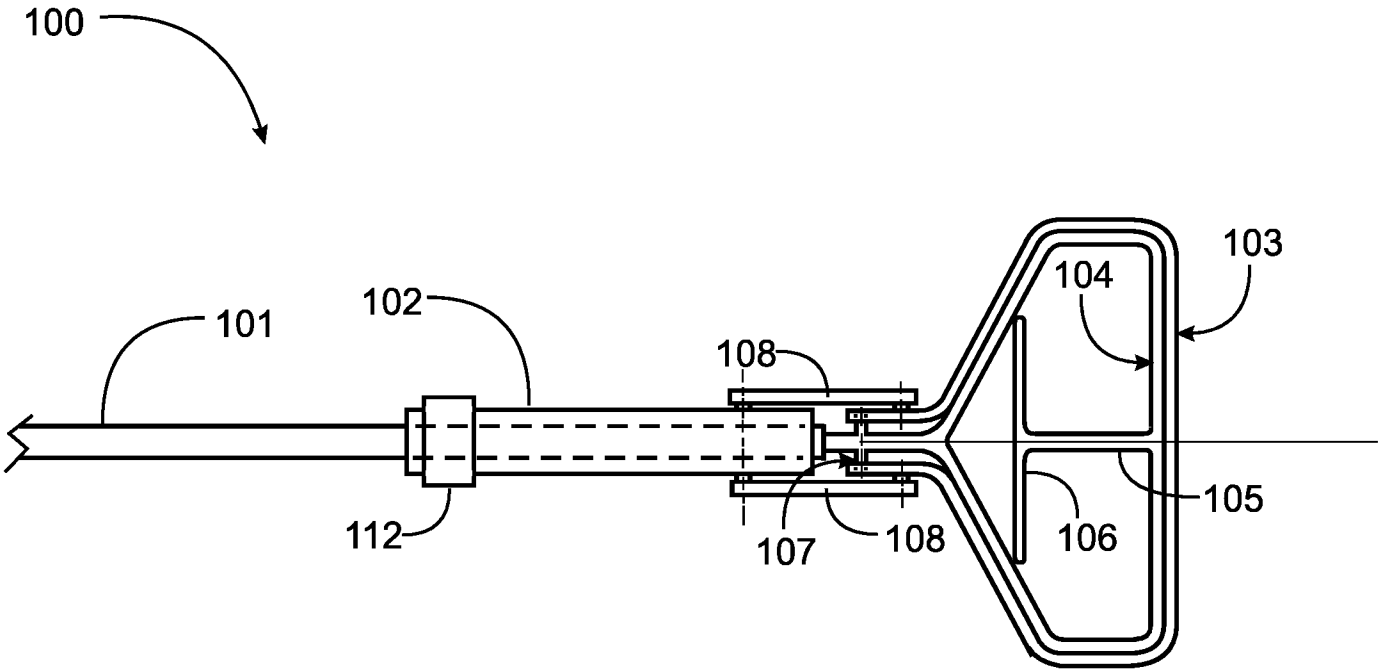
FIG. 1 is a plan view of a skimmer net apparatus according to an embodiment of the present invention.

FIG. 1 is a plan view of a skimmer apparatus 100 according to an embodiment of the present invention. Handle 101 is shown as cut off on one end, as the actual length of the handle may vary in different circumstances. For example, for use with a swimming pool the handle may be quite long, such as perhaps twelve feet or more. For use with a spa the handle may be much shorter. The length of the handle has little bearing on the invention.

In one embodiment of the invention a fixed frame 104 is rigidly joined to handle 101, and serves as an anchor for a rod 106 which defines a bottom of a net for the skimmer apparatus. Rod 106 is a straight rod and has an axis that is offset from and at a right angle to a long axis of handle 101. Rod 106 is projected in its fixed position at an end of extension 105 extending from a central point on a front side of fixed frame 104. Fixed frame 104 is in a shape of a top of a skimmer net, but in embodiments of the invention net material is not joined to fixed frame 104.

A movable frame 103 in the shape of fixed frame 104 fits just outside fixed frame 104, and is pivoted at pivot axis 107 to an extension of handle 101, such that movable frame 103 may rotate around the pivot axis. Movable frame 103 is manipulated by links 108 pivoted to the movable frame and to a slider 102 that translates along handle 101. A locking mechanism 112 is provided on slider 102 in some embodiments to lock the slider to the handle in different positions as desired by a user.

Figure 2A:
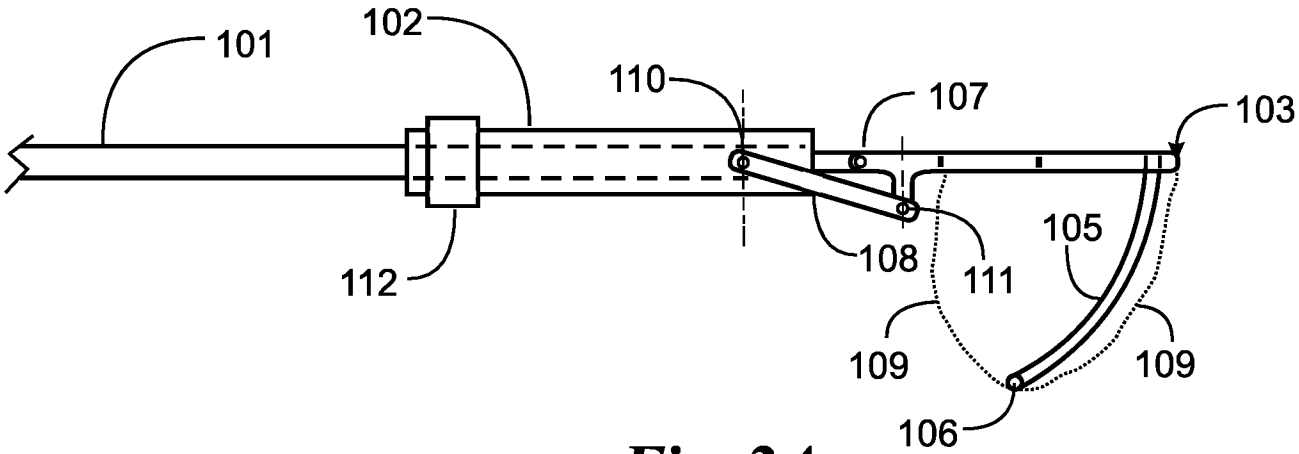
FIG. 2A is a side elevation view of the skimmer net apparatus of FIG. 1 before operation.

FIG. 2A is a side elevation view of the skimmer apparatus of FIG. 1 before operation. Movable frame 103 is seen in side view, but fixed frame 104, fitted inside of movable frame 103 is not seen in FIG. 2A. Extension 105, from fixed frame 104 is shown connected to rod 106. Net material is attached around periphery of movable frame 103 and forming a net having rod 106 anchoring the bottom of the net. Dotted lined 109 show approximate extension of net material.

It may be seen in FIG. 2A that links 108 pivot about a pivot axis 110 on slider 102 that intersects the axis of the slider, but attach to movable frame 103 at a pivot axis 111 offset below the axis of the handle and slider, such that movement of the slider on the handle will cause movable frame 103 to rotate downward about pivot axis 107.

Figure 2B:
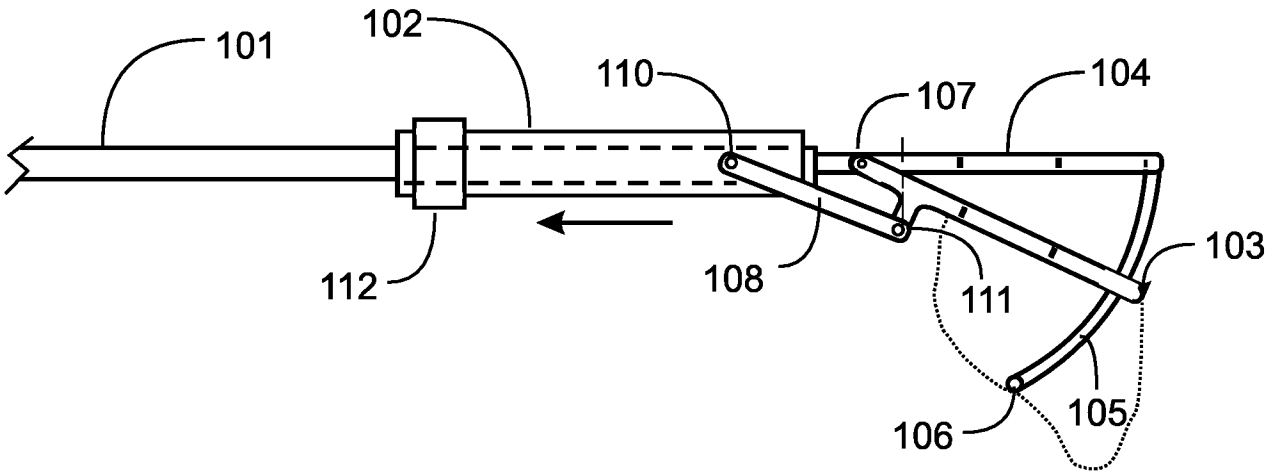
FIG. 2B is a side elevation view of the skimmer net apparatus of FIG. 1 and FIG. 2A with an emptying mechanism partially deployed in an embodiment of the invention.

FIG. 2B is a side elevation view of the skimmer apparatus of FIG. 1 and FIG. 2A with movable frame 103 partially rotated about pivot axis 107 by moving slider 102 a short distance along handle 101 away from the net frames. The net sides 109 are shown still attached to movable frame 103 and to rod 106 anchoring the bottom of the net.

Figure 2C:
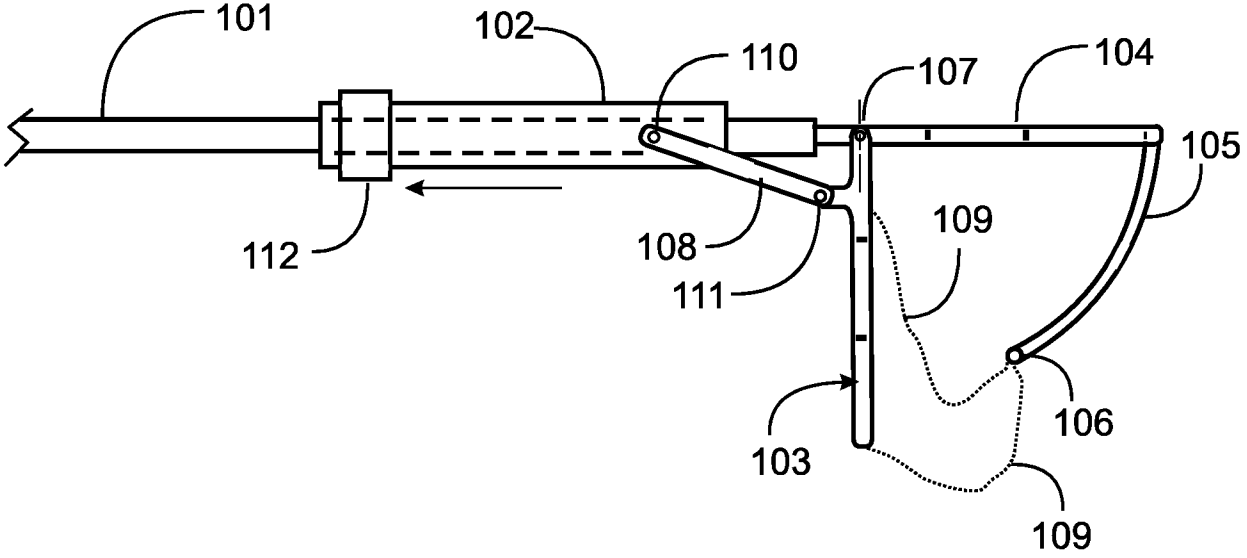
FIG. 2C is a side elevation view of the skimmer net apparatus of FIGS. 1, 2A and 2B with the emptying mechanism more fully deployed than shown in FIG. 2B in an embodiment of the invention.

FIG. 2C is a side elevation view of the skimmer apparatus of FIGS. 1, 2A and 2B with the emptying mechanism more fully deployed than shown in FIG. 2B in an embodiment of the invention. In the view of FIG. 2C movable frame 103 has rotated to a vertical position, having passed the position of rod 106, holding the bottom of the net. At this point in rotation the net has been completely inverted. That is, the net has been turned inside-out. Any material that was in the net before movable frame 103 was rotated is now dumped out of the net if loose enough to do so. Material like algae and muck may be at least partially dislodged by shaking the apparatus. The inverted net may also be held in a flowing stream to dislodge material, or a hose, for example, may be trained on the inverted net to dislodge collected material and return the net to clan condition for reuse, after returning movable frame 103 to its original position, restoring the net to its original shape.

It will be clear that the circumstance shown in FIG. 2C is not the maximum rotation of movable frame 103. Frame 103 may be rotated further until constrained by slider 102.

In some embodiments limit stops may be incorporated to constrain the translation of slider 102 relative to handle 101, and therefore the degree of rotation of movable frame 103 relative to fixed frame 104. A locking mechanism may also in some embodiments be employed to position and lock slider 112 at different positions relative to handle 101, and one such lock may be employed to lock the apparatus at the circumstance that frames 103 and 104 are in contact, such that the apparatus appears and functions as a conventional skimmer net apparatus.

The skilled person will understand that the embodiments illustrated and described above are exemplary, and that the mechanisms described may be implemented in other ways to turn the net inside out. Alterations may be made in these embodiments within the scope of the invention. Limitations to the invention are only recited in the claims below.

I claim:

1. A skimmer net apparatus, comprising:

a handle having a first and a second end and a length having an axis;

a net-bottom-rod having a length with an axis at a right angle to the axis of the handle, offset from the axis of the handle by a depth dimension;

a rigid coupling joining the net-bottom-rod to an extension of the handle;

a movable frame having a shape enabled to secure a net, with a width and a length, the movable frame rotatable about an axis at a right angle to the axis of the handle;

a slider implemented on the handle, translatable in a direction of the axis of the handle;

a linkage mechanism joined to the movable frame and to the slider, such that translating the slider along the handle rotates the movable frame about the axis at a right angle to the axis of the handle; and net material joined to the movable frame along the shape defining the net extending to the net-bottom-rod;

wherein with the movable frame in a horizontal position forward of the handle, the net is implemented between the shape of the movable frame and the net-bottom-rod, enabling capture of material in the net by manipulation of the handle, and wherein moving the slider in a direction away from the net employs the linkage mechanism to rotate the movable frame about the axis at a right angle to the axis of the handle, past the net-bottom-rod, such that the net is turned inside out, facilitating divesting material captured in the net.

2. The skimmer net apparatus of claim 1 further comprising a fixed frame in the shape of the movable frame, the fixed frame rigidly joined to the extension of the handle, such that the movable frame in a horizontal position surrounds and locates onto the fixed frame, providing the fixed and movable frames in a common position.

3. The skimmer net apparatus of claim 2 wherein the a rigid coupling joining the net-bottom-rod, joins rigidly to a front edge of the fixed frame.

4. The skimmer net apparatus of claim 1 further comprising a locking mechanism usable to lock the slider to the handle in a variety of different positions.

5. The skimmer net apparatus of claim 4 wherein one of the variety of different position in which the slider may be locked to the handle is the position where the movable frame is in a horizontal position forward of the handle.

6. A method for emptying a skimmer net without hand contact, comprising:

positioning a net-bottom-rod at a right angle to and offset from an axis of a handle having a first and a second end and a length, with the net-bottom-rod rigidly attached to an extension of the handle;

pivoting a movable frame having a shape defining a top of the net, with a width and a length, about an axis at a right angle to the extension of the handle;

imposing net material joined around a periphery of the movable frame and the net-bottom-rod, providing the net with an open top defined by the movable frame and a fixed bottom defined by the net-bottom-rod;

imposing a linkage mechanism between a slider on the handle and an offset from the movable frame, such that retracting the slider on the handle rotates the movable frame downward around the axis at a right angle to the extension of the handle; and moving the slider along the handle away from the extension of the handle, causing the movable frame to rotate about the axis at a right angle to the extension of the handle, past the fixed net bottom held by the net-bottom-rod, inverting the net to be inside out, and emptying any material collected in the net.

7. The method of claim 6 further comprising implementing a fixed frame in the shape of the movable frame, the fixed frame rigidly joined to the extension of the handle, such that the movable frame in a horizontal position surrounds and locates onto the fixed frame, providing the fixed and movable frames in a common position.

8. The method of claim 7 further comprising joining the net-bottom-rod rigidly to a front edge of the fixed frame.

9. The method of claim 6 further comprising imposing a locking mechanism on the slider, the locking mechanism usable to lock the slider to the handle in a variety of different positions.

10. The method of claim 9 wherein one of the variety of different position in which the slider may be locked to the handle is the position where the movable frame is in a horizontal position forward of the handle.

* * * * *